US011434450B2

(12) United States Patent
Rivera Cruz et al.

(10) Patent No.: US 11,434,450 B2
(45) **Date of Patent: *Sep. 6, 2022**

(54) CLEANING COMPOSITIONS AND METHODS FOR MODIFYING TURBIDITY

(71) Applicant: Colgate-Palmolive Company, New York, NY (US)

(72) Inventors: Luis Javier Rivera Cruz, Mexico City (MX); Victor Omar Serrano Aguilar, Coyoacán (MX); Jorge Antonio Maldonado Ortega, Delegacion Miguel Hidalgo CP (MX); Edna Ambundo, Cranbury, NJ (US)

(73) Assignee: Colgate-Palmolive Company, New York, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/472,265

(22) PCT Filed: Dec. 18, 2017

(86) PCT No.: PCT/US2017/067128

§ 371 (c)(1),
(2) Date: Jun. 21, 2019

(87) PCT Pub. No.: WO2018/125646

PCT Pub. Date: Jul. 5, 2018

(65) Prior Publication Data

US 2019/0322962 A1 Oct. 24, 2019

Related U.S. Application Data

(60) Provisional application No. 62/439,234, filed on Dec. 27, 2016.

(51) Int. Cl.

| | |
|---|---|
| ***C11D 1/00*** | (2006.01) |
| ***C11D 1/83*** | (2006.01) |
| ***C11D 1/24*** | (2006.01) |
| ***C11D 1/29*** | (2006.01) |
| ***C11D 1/72*** | (2006.01) |
| ***C11D 3/04*** | (2006.01) |
| ***C11D 3/20*** | (2006.01) |
| ***C11D 3/50*** | (2006.01) |

(52) U.S. Cl.

CPC ..... *C11D 1/83* (2013.01); *C11D 1/24* (2013.01); *C11D 1/29* (2013.01); *C11D 1/72* (2013.01); *C11D 3/046* (2013.01); *C11D 3/2086* (2013.01); *C11D 3/50* (2013.01)

(58) Field of Classification Search

CPC .... C11D 1/83; C11D 1/24; C11D 1/29; C11D 1/72

See application file for complete search history.

(56) References Cited

U.S. PATENT DOCUMENTS

| | | | | |
|---|---|---|---|---|
| 6,194,362 | B1 | 2/2001 | Trinh et al. | |
| 6,462,010 | B1 | 10/2002 | Aszman et al. | |
| 7,939,488 | B2 | 5/2011 | Scheuing et al. | |
| 2009/0143274 | A1* | 6/2009 | Benes | C11D 1/22 510/492 |
| 2010/0234269 | A1 | 9/2010 | Dreilinger et al. | |
| 2012/0046214 | A1* | 2/2012 | Braeckman | C11D 1/94 510/235 |
| 2015/0264922 | A1 | 9/2015 | Scheuing et al. | |
| 2015/0275148 | A1* | 10/2015 | Joiner | C11D 1/83 510/393 |
| 2018/0201877 | A1 | 7/2018 | Maldonado Ortega et al. | |

FOREIGN PATENT DOCUMENTS

| | | |
|---|---|---|
| WO | 2008/033280 | 3/2008 |
| WO | 2017/010971 | 1/2017 |

OTHER PUBLICATIONS

International Search Report and Written Opinion of the International Searching Authority in International Application No. PCT/US2017/067128, dated Mar. 23, 2018.

* cited by examiner

*Primary Examiner* — Necholus Ogden, Jr.

(57) ABSTRACT

A cleaning composition includes at least two anionic surfactants, an ionic agent, a nonionic surfactant and a fragrance. The at least two anionic surfactants include a linear alkylbenzene sulfonate (LAS) and a sodium lauryl ether sulfate (SLES). The LAS and the SLES are present in the cleaning composition in a total amount combined of about 1%-2% by weight. A weight ratio of LAS:SLES is about 3:1 to about 1:1 or about 6:1 to about 4:1. The ionic agent is present in the cleaning composition in an amount of about 0.01% to about 1% by weight. The nonionic surfactant is present in the cleaning composition in an amount of at least about 0.45% by weight.

14 Claims, No Drawings

CLEANING COMPOSITIONS AND METHODS FOR MODIFYING TURBIDITY

CROSS-REFERENCE TO RELATED APPLICATIONS

This application claims priority to U.S. Provisional Patent Application No. 62/439,234, filed Dec. 27, 2016, which is incorporated herein by reference.

BACKGROUND

Shine, cleaning effectiveness and fragrance are key performance characteristic of cleaning compositions. When consumers compare two cleaning products, such as bucket-dilutable cleaners, with the same base formula and similar fragrances, they often correlate the product's ability to shine a surface to the quality of the cleaner.

Two cleaning compositions containing the same amount and type of fragrance, however, may not result in the same fragrance performance (e.g., hedonics, release, long lastingness) or shine performance (e.g., gloss). Specific formula components such as polymers, silicons, and waxes, for example can be deposited on surfaces to improve gloss measurements, but are required in relatively large amounts and are thus cost prohibitive. Meanwhile other formula components such as surfactants, polymers and salts, for example, can interact with and impact fragrance performance. The traditional approach used to address any negative impact resulting from the interaction between formula ingredients and fragrance components has been to modify the composition of the fragrance to compensate for shortcomings in fragrance performance driven by the formula. However, depending upon cost and availability, modifying the composition of a fragrance, such as increasing the amount, may not be cost-effective or feasible. Accordingly, there is a desire in the art to increase fragrance performance in cleaning compositions without modifying the composition of a fragrance.

BRIEF SUMMARY

The present disclosures provides a cleaning composition including: at least two anionic surfactants, wherein the at least two anionic surfactants comprise a linear alkylbenzene sulfonate (LAS) and a sodium lauryl ether sulfate (SLES), wherein a total of the LAS and the SLES are present in the cleaning composition in a total amount combined of about 1%-2% by weight and wherein a weight ratio of LAS:SLES is about 3:1 to about 1:1 or about 6:1 to about 4:1; an ionic agent in an amount of about 0.01% to about 1% by weight; a nonionic surfactant in an amount of at least about 0.45% by weight, and a fragrance.

In an implementation of the cleaning composition disclosed herein, the cleaning composition is a bucket-dilutable cleaning composition.

In an implementation of any of the disclosed cleaning compositions, the LAS:SLES ratio is about 4:1.

In an implementation of any of the disclosed cleaning compositions, the fragrance is present in the cleaning composition in an amount of about 0.5% to about 2% by weight.

In an implementation of any of the disclosed cleaning compositions, the nonionic surfactant is a C9-C11 alkanol condensed with 7 to 8 moles of ethylene oxide.

In an implementation of any of the disclosed cleaning compositions, the nonionic surfactant is present in the cleaning composition in an amount of about 0.5% to about 1.5% by weight.

In an implementation of any of the disclosed cleaning compositions, the cleaning composition has a turbidity of less than 10 NTU.

In an implementation of any of the disclosed cleaning compositions, the cleaning composition has a turbidity of from about 4 NTU to about 9 NTU.

In an implementation of any of the disclosed cleaning compositions, the ionic agent is present in the composition in an amount of from greater than 0% to about 1% by weight.

In an implementation of any of the disclosed cleaning compositions, the ionic agent comprises a metal salt electrolyte.

In an implementation of any of the disclosed cleaning compositions, the ionic agent comprises a metal acid.

In an implementation of any of the disclosed cleaning compositions, the ionic agent comprises sodium chloride, sodium citrate, or a combination thereof.

Also provided herein is a method of preparing a cleaning composition wherein the cleaning composition includes a fragrance, the method comprising: combining at least two anionic surfactants, wherein the at least two anionic surfactants comprise a linear alkylbenzene sulfonate (LAS) and a sodium lauryl ether sulfate (SLES), to form a mixture having a weight ratio of LAS:SLES of about 3:1 to about 1:1 or about 6:1 to about 4:1; adding the mixture, an ionic agent; and a nonionic surfactant to the cleaning composition, wherein the cleaning composition includes a fragrance; wherein the mixture comprises a total amount combined of LAS and SLAS of about 1% to about 2% by weight of the cleaning composition, wherein the ionic agent comprises an amount of about 0.01% to about 1% by weight of the cleaning composition, and wherein the nonionic surfactant comprises an amount of at least 0.45% by weight of the cleaning composition.

In an implementation of any of the disclosed methods, the nonionic surfactant is a C9-C11 alkanol condensed with 7 to 8 moles of ethylene oxide.

In an implementation of any of the disclosed methods, the nonionic surfactant is present in the cleaning composition in an amount of about 0.5% to about 1.5% by weight.

In an implementation of any of the disclosed methods, the cleaning composition has a turbidity of less than about 10 NTU.

In an implementation of any of the disclosed methods, the fragrance is present in the cleaning composition in an amount of about 0.5% to about 2% by weight.

In an implementation of any of the disclosed methods, the cleaning composition is a bucket-dilutable cleaning composition.

Also provided herein is a method of cleaning a substrate, the method including: applying the cleaning composition of any one of compositions described herein to the substrate; and wiping the cleaning composition across the substrate.

In an implementation of the method of cleaning a substrate, the cleaning composition is a bucket-dilutable cleaner.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

DETAILED DESCRIPTION

The following description of the preferred embodiment(s) is merely exemplary in nature and is in no way intended to limit the invention, its application, or uses.

As used throughout, ranges are used as shorthand for describing each and every value that is within the range. Any value within the range can be selected as the terminus of the range. In addition, all references cited herein are hereby incorporated by referenced in their entireties. In the event of a conflict in a definition in the present disclosure and that of a cited reference, the present disclosure controls.

Unless otherwise specified, all percentages and amounts expressed herein and elsewhere in the specification should be understood to refer to percentages by weight. The amounts given are based on the active weight of the material.

Cleaning Compositions

The present disclosure is directed to cleaning compositions with controlled turbidity. As described herein, turbidity is controlled in the present cleaning compositions by modifying the amount and/or ratio of specific ionic agent(s) in the cleaning composition as described herein. Accordingly, in some implementations, the cleaning compositions of the instant disclosure provide a controlled turbidity.

As used herein, a "cleaning composition" is any composition that may be useful in cleaning substrates, such as household surfaces. A "surface" refers to the surface of any appliance or fixture, and may include hard surfaces such as counters, sinks, cabinets, walls, the surfaces of appliances such as kitchen appliances (e.g., stoves, conventional or microwave ovens, refrigerators, dishwashers and the like), or bathroom appliances and fixtures (e.g., sinks, toilets, bathtubs, tiles, shower curtains and doors), wood or glass surfaces, floors, utensils or dishes, as well as furniture or clothing (including carpets or rugs, cloths, bedding, leather, sponges and mops, polymeric or fabric surfaces or objects made from natural or synthetic materials, e.g., protective gear or sports equipment). Accordingly, the present compositions may be formulated into hard surface cleaners, spray cleaners, floor cleaners, microwave cleaners, stove top cleaners, etc. "Turbidity," as used herein, is defined as the cloudiness or haziness of a solution caused by finely suspended particles. Turbidity is measured using NTU's, (nephelometric turbidity units).

Typically, the present cleaning compositions are in the form of a bucket-dilutable cleaner. As used herein, "bucket-dilutable" refers to a cleaning composition that may be (but does not necessarily have to be) diluted with water, for example, in a bucket or other container, prior to use.

Anionic Surfactant

In some implementations, the cleaning compositions of the present disclosure comprise at least two anionic surfactants, typically, a linear alkylbenzene sulfonate (also referred to herein as LAS) and a sodium lauryl ether sulfate (also referred to herein as SLES). In various implementations, the linear alkylbenzene sulfonate has a higher content of 3-phenyl (or higher) isomers and a correspondingly lower content (well below 50%) of 2-phenyl (or lower) isomers, such as those sulfonates wherein the benzene ring is attached mostly at the 3 or higher (for example 4, 5, 6 or 7) position of the alkyl group and the content of the isomers in which the benzene ring is attached in the 2 or 1 position is correspondingly low. Suitable linear alkylbenzene sulfonates that can be used in the present cleaning compositions include those in which the alkyls have 10 to 13 carbon atoms. Other suitable linear alkylbenzene sulfonates are found in U.S. Pat. No. 3,320,174, which is herein incorporated by reference in its entirety. Typically, the linear alkylbenzene sulfonate of the present cleaning compositions is sodium dodecyl benzene sulfonate.

In various implementations, the present cleaning compositions contain sodium lauryl ether sulfate, also known as sodium laureth sulfate. In at least one implementation, the sodium lauryl ether sulfate has an average of about 1 to about 10 moles of ethylene oxide per mole. In at least one implementation, there is an average of about 2 to about 10 moles of ethylene oxide per mole. In at least one implementation, there is an average of about 2 to about 3 moles of ethylene oxide per mole.

In some implementations, the anionic surfactants, for example, a combination of LAS and SLES, are present in the instant cleaning compositions in ratios and amounts that enhance the fragrance performance of the compositions in comparison to a reference cleaning composition as described herein. In other implementations, a combination of LAS and SLES are present in the instant cleaning compositions in ratios and amounts that diminish the fragrance performance of the cleaning compositions in comparison to a reference cleaning composition as also described herein.

In some implementations, the cleaning compositions of the present disclosure contain a total amount of anionic surfactant, such as a total amount of LAS and SLES combined, of about 0.1% to about 3.5% by weight, about 0.5% to about 2%, about 0.8% to about 1.5%, about 1% to about 2%, about 1.0% to about 1.3%, and about 1.6% to about 1.7%.

In some implementations, the ratio of LAS to SLES ranges from about 6:1 to about 1:0, such as about 5:1 to about 1:1, about 4:1 to about 1:1, about 31 to about 1:1 and about 2:1 to about 1:1. More typically, the ratio of LAS to SLES ranges from about 3:1 to about 1:1 or about 6:1 to about 4:1.

In some implementations, a cleaning composition of the instant disclosure contains a total amount of LAS and SLES of about 1%-2% by weight, wherein the LAS:SLES is present in the composition at a ratio of about 4:1.

Nonionic Surfactant

In some implementations, the present cleaning composition further contains a nonionic surfactant. Suitable nonionic surfactants include water soluble nonionic surfactants, which are commercially well known and include the primary aliphatic alcohol ethoxylates, secondary aliphatic alcohol ethoxylates, alkylphenol ethoxylates and ethylene-oxide propylene oxide condensates on primary alkanols, such a PLURAFAC™ surfactants and condensates of ethylene oxide with sorbitan fatty acid esters such as the TWEEN™ surfactants. More typically, nonionic surfactants are chosen from primary alcohol ethoxylates, such as C9 to C11 alcohols. Exemplary C9 to C11 alcohol ethoxylates may include NEODOL® 91-8, also known as C9-C11 Pareth 8, a polyethylene glycol ether with an average of 8 moles of ethylene oxide per mole of alcohol. Other suitable nonionic surfactants are described in International Publication WO 2007/001593 to Simon et al. and U.S. Pat. No. 6,342,473 to Kott et al., herein incorporated by reference in their entireties. In various implementations, the nonionic surfactant is present in amounts of about 0.5% to about 6%, about 1% to 4.5%, about 2% to about 3.5%, typically about 3%, more typically, about 1.25%, even more typically about 0.4%-1%, such as 0.5%-1% by weight of the cleaning composition.

Fragrance

In various implementations, the present cleaning composition contains one or more fragrances. As used herein the term "fragrance" is used in its ordinary sense to refer to and include any fragrant substance or mixture of substances including natural (i.e., obtained by extraction of flower, herb, blossom or plant), and/or artificial (i.e., mixture of natural oils or oil constituents and/or synthetically produced substances) odoriferous substances. Typically, fragrances are complex mixtures or blends of various organic compounds such as alcohols, aldehydes, esters, and varying amounts of essential oils.

Suitable alcohols which may be used in a fragrance include farnesol, geraniol, linalool, nerol, phenylethyl alcohol, rhodinol, cinnamic alcohol, (Z)-hex-3-en-1-ol, menthol, α-terpineol. Suitable aldehydes include citral, α-hexyl cinnamaldehyde, Lilial, methylionone, verbenone, nootkatone, geranylacetone. Suitable esters include allyl phenoxyacetate, benzyl salicylate, cinnamyl propionate, citronellyl acetate, decyl acetate, dimethylbenzylcarbinyl acetate, dimethylbenzylcarbinyl butyrate, ethyl acetoacetate, cis-3-hexenyl isobutyrate, cis-3-hexenyl salicylate, linalyl acetate, methyl dihydrojasmonate, styralyl propionate, vetiveryl acetate, benzyl acetate, geranyl acetate.

Suitable essential oils include Anethole 20/21 natural, Aniseed oil china star, Aniseed oil globe brand, Balsam (Peru), Basil oil (India), Black pepper oil, Black pepper oleoresin 40/20, Bois de Rose (Brazil) FOB, Borneol Flakes (China), Camphor oil, Camphor powder synthetic technical, *Cananga* oil (Java), Cardamom oil, *Cassia* oil (China), Cedarwood oil (China) BP, Cinnamon bark oil, Cinnamon leaf oil, Citronella oil, Clove bud oil, Clove leaf, Coriander (Russia), Coumarin (China), Cyclamen Aldehyde, Diphenyl oxide, Ethyl vanilin, Eucalyptol, *Eucalyptus* oil, *Eucalyptus citriodora*, Fennel oil, Geranium oil, Ginger oil, Ginger oleoresin (India), White grapefruit oil, Guaiacwood oil, Gurjun balsam, Heliotropin, Isobornyl acetate, Isolongifolene, Juniper berry oil, L-methyl acetate, Lavender oil, Lemon oil, Lemongrass oil, Lime oil distilled, *Litsea Cubeba* oil, Longifolene, Menthol crystals, Methyl cedryl ketone, Methyl chavicol, Methyl salicylate, Musk ambrette, Musk ketone, Musk xylol, Nutmeg oil, Orange oil, Patchouli oil, Peppermint oil, Phenyl ethyl alcohol, Pimento berry oil, Pimento leaf oil, Rosalin, Sandalwood oil, Sandenol, Sage oil, Clary sage, *Sassafras* oil, Spearmint oil, Spike lavender, *Tagetes*, Tea tree oil, Vanilin, Vetyver oil (Java), Wintergreen, Allocimene, ARBANEX™, ARBANOL®, Bergamot oils, Camphene, Alpha-Campholenic aldehyde, I-Carvone, Cineoles, Citral, Citronellol Terpenes, Alpha-Citronellol, Citronellyl Acetate, Citronellyl Nitrile, Para-Cymene, Dihydroanethole, Dihydrocarveol, d-Dihydrocarvone, Dihydrolinalool, Dihydromyrcene, Dihydromyrcenol, Dihydromyrcenyl Acetate, Dihydroterpineol, Dimethyloctanal, Dimethyloctanol, Dimethyloctanyl Acetate, Estragole, Ethyl-2 Methylbutyrate, Fenchol, FERNLOL™, FLORILYS™, Geraniol, Geranyl Acetate, Geranyl Nitrile, GLIDMINT™, Mint oils, GLIDOX™, Grapefruit oils, trans-2-Hexenal, trans-2-Hexenol, cis-3-Hexenyl Isovalerate, cis-3-Hexanyl-2-methylbutyrate, Hexyl Isovalerate, Hexyl-2-methylbutyrate, Hydroxycitronellal, Ionone, Isobornyl Methylether, Linalool, Linalool Oxide, Linalyl Acetate, Menthane Hydroperoxide, I-Methyl Acetate, Methyl Hexyl Ether, Methyl-2-methylbutyrate, 2-Methylbutyl Isovalerate, Myrcene, Nerol, Neryl Acetate, 3-Octanol, 3-Octyl Acetate, Phenyl Ethyl-2-methylbutyrate, Petitgrain oil, cis-Pinane, Pinane Hydroperoxide, Pinanol, Pine Ester, Pine Needle oils, Pine oil, alpha-Pinene, beta-Pinene, alpha-Pinene Oxide, Plinol, Plinyl Acetate, Pseudo Ionone, Rhodinol, Rhodinyl Acetate, Spice oils, alpha-Terpinene, gamma-Terpinene, Terpinene-4-OL, Terpineol, Terpinolene, Terpinyl Acetate, Tetrahydrolinalool, Tetrahydrolinalyl Acetate, Tetrahydromyrcenol, TETRALOL®, Tomato oils, Vitalizair, ZESTORAL™, HINOKITIOL™ and THUJOPSIS DOLABRATA™. Additionally, some suitable fragrances may be supplied by the fragrance houses as mixtures in the form of proprietary specialty accords.

The amount of fragrance or mixtures of fragrance that may be used in the cleaning compositions of the present disclosure range from about 0.001% to about 10%, typically from about 0.001% to about 5% by weight, more typically about 0.001% to about 1%, even more typically 0.5% to 2%, such as about 0.8% to about 0.9%.

Ionic Agent

As described above, the SLES/LAS ratio can provide an enhanced fragrance performance in cleaning compositions (e.g., the SLES/LAS ratio can improve the fragrance release and long lastingness). However, increased amount of SLES in the composition can decrease the fragrance's solubility. As the SLES amount is increased, fragrance precipitates out of solution and the resulting suspended fragrance particles cause the composition to appear hazy (i.e., increased turbidity) until the non-soluble fragrance components migrates to the top of the solution becoming a heterogeneous blend. To stop the solution separation in two phases and control the increased turbidity, an ionic agent can be added to make an homogenous composition that becomes more stable and appear more transparent (i.e., decreased turbidity). While not limited to any particular theory, it is believed that addition of ionic agent in the composition results in the generation of micelle structures with polar charges bonded/stabilized by the additional ionic charges present in the solution and that such interaction results in a stable solution for which separation is delayed.

In some implementations, the present cleaning composition contains one or more ionic agents. As used herein the term "ionic agent" refers to and includes any ionizable material or mixture of ionizable materials that undergo ionic dissociation in an aqueous composition to serve as ion sources for stabilizing the solution and decreasing the turbidity of the composition. Typically, ionic agents are ionic solids or liquids of various ionic compounds such as organic and inorganic electrolytes.

Suitable ionic agents for the cleaning compositions described herein include metal ions that can form an organic or inorganic salt which chlorides, hydroxides, phosphates, iminodisuccinates and/or citrates. Such metal ions include, for example, sodium, chloride, potassium and/or magnesium. In certain implementations, the suitable ionic agent of the cleaning compositions described herein may be selected from strongly ionizing salts, including metal alkali salts such as calcium chloride, sodium chloride (NaCl), and acid salts such as sodium citrate (e.g., monosodium citrate, disodium citrate, trisodium citrate, or mixtures thereof).

The amount of ionic agent or the amount of the mixtures of ionic agents that may be used in the cleaning compositions of the present disclosure preferably range from greater than 0% to about 1%, typically from about 0.01% to about 1%, more typically from about 0.01% to about 0.5%, even more typically 0.025% to 0.5%, such as about 0.025% to about 0.125% by weight of the cleaning composition.

In various implementations, the amount of ionic agent, the total amount of anionic surfactant, and the weight ratio of at least two anionic surfactants, for example, the ratio of LAS:SLES, are selected such that the cleaning composition (including the mixture of the LAS and SLES, the ionic agent, the nonionic surfactant, and the fragrance) preferably has a turbidity of equal to or less than 10 NTU, for example, a turbidity of from about 3 NTU to about 10 NTU, such as a turbidity of from about 4 NTU to about 9 NTU, including a turbidity of from about 5 NTU to about 7 NTU.

Additional Ingredients

In various implementations, the compositions may further comprise additional ingredients, such as, for example, any other additives that are used in cleaning compositions, such as colorants, rheology modifiers, structuring agents, hydrotropes, whitening agents, reducing agents, enzymes, enzyme stabilizing agents, builders, bleaches, photobleaches, bleach catalysts, soil release agents, dye transfer inhibitors, buffers, soil repellents, water-resistance agents, suspending agents, aesthetic agents, preservatives and combinations thereof. An exemplary preservative may include isothiazolinone. These materials can be used in any desired amount.

In certain implementations, the cleaning compositions disclosed herein are aqueous compositions. The amount of water can be any amount. In certain implementations, the amount of water can be greater than 90% by weight of the composition, such as greater than 91%, greater than 92%, greater than 93%, or greater than 94% by weight of the composition. In certain implementations, the amount of water is about 95% by weight of the composition or greater than about 95% by weight of the composition, such as greater than about 96%, greater than about 97%, or ranging from about 90% to about 98%.

In some implementations, the compositions can be supplied as ready-to-use compositions. In other implementations, the cleaning composition is supplied as a concentrate that can later be diluted with water. The composition can be at least 2, at least 3, at least 4, or at least 5 times concentrated, in which case the amounts of materials are adjusted accordingly.

In some implementations, the ready-to-use compositions or the diluted compositions can be further diluted with water to any desired amount. In some implementations, the ready-to-use or diluted cleaning compositions of the present disclosure can be further diluted at least 2, at least 3, at least 4, at least 5 times, at least 10 times, at least 40 times, at least 70 times or at least 100 times.

In some implementations, one or more layers formed from application of the present cleaning compositions, for example, such as upon applying the present cleaning compositions on a substrate, may exhibit an enhanced shine. As used herein "enhanced shine" means a measureable or perceived increased glossiness of at least one layer formed by application of the inventive cleaning composition on a surface in comparison to a standard, such as at least one layer formed on the same or similar surface by application of a reference cleaning composition thereto as described herein.

Any method known in the art for evaluation of the gloss exhibited by a layer formed by application of a cleaning composition onto a surface may be used to assess shine performance. For example, to accurately determine the quantitative performance of the present cleaning compositions or dilutions of the present cleaning compositions, such evaluating may include a measurement of specular reflection and quantifying the amount of reflection with a gloss meter, with the type of surface to be measured determining the gloss meter angle to be used. In brief, a gloss meter light source directs a light at a specific angle to the test surface, an amount of reflected light is measured and the gloss meter provides gloss measurement expressed as gloss units (GU).

As used herein "a reference cleaning composition" is a cleaning composition formulated to contain the same amount and type of a fragrance (also referred to herein as a "reference fragrance") and at least two of the same type of anionic surfactants as a cleaning composition of the present disclosure, e.g., the reference and the present cleaning compositions may both contain LAS and SLES and the same amount and type of fragrance. However, turbidity is different between the reference cleaning composition and the cleaning compositions of the present disclosure even in the case where the reference cleaning composition and the cleaning compositions of the present disclosure include the same amount of LAS and SLES as one another. For example, in some implementations, a cleaning composition as described herein may be formulated to contain about 1% by weight of a fragrance, but will nevertheless have a lower turbidity and may be capable of forming at least one layer having a higher gloss and/or maintaining a gloss for more applicants than a reference cleaning composition, which also contains the same amount of LAS, SLES and fragrance, with the turbidity difference due, at least in part, to inclusion of anionic surfactant (as in the exemplary compositions described herein) changing the solubility of the fragrance.

In some implementations, a reference cleaning composition contains the same anionic surfactants, nonionic surfactants and fragrance, as well as the same amounts of these ingredients, as the cleaning compositions described herein. However, turbidity may differ between the present cleaning compositions and the reference cleaning composition. For example, in some implementations, the present cleaning compositions have a turbidity of less than or equal to about 10 NTU, while the reference cleaning composition contains a turbidity of greater than 10 NTU.

In yet other implementations, a reference cleaning composition contains all of the same ingredients and amounts of ingredients as cleaning compositions of the present disclosure including anionic surfactants, nonionic surfactants, fragrance, buffer, coloring agent, preservatives and water, while corresponding turbidity is different between the cleaning compositions of the present disclosure and the reference cleaning composition.

Methods

The present disclosure is also directed to a method of preparing a cleaning composition with controlled turbidity, and which is a mixture of ingredients. In some implementations, the method includes combining at least two anionic surfactants, such as LAS and SLES, to form a mixture. The amounts and ratios of the at least two anionic surfactants used in the present methods are the same as previously described. Typically, about 0.5%-2% by weight of a combination of LAS and SLES is included in the mixture using a ratio of LAS to SLES of about 6:1 to about 1:1, such as about 5:1 to 2:1 or about 4:1 to 3:1. In some implementations, an ionic agent and fragrance is then added to the mixture. Typically, about 0.5%-1.5% by weight of the cleaning composition is included in the mixture. In various implementations, water, nonionic surfactants, and additional components such as buffers, preservatives and coloring agents of the types and amounts described herein are also added to the mixture. The cleaning composition, including the mixture of the LAS and SLES, the ionic agent and the fragrance, has a turbidity such as a turbidity of less than 10 NTU, for example a turbidity of from about 3 NTU to about 9 NTU, including a turbidity of from about 5 NTU to about 7 NTU.

In other implementations, the cleaning compositions disclosed herein can be used to clean substrates by applying the composition to a substrate and wiping the composition to at least partially cover the substrate. The applying can include at least one application, for example two applications, three applications, etc. In certain implementations, the cleaning composition is formulated to be a bucket dilutable cleaner.

The present disclosure is also directed to a method of formulating a cleaning composition having an enhanced fragrance performance by comparing the fragrance performance between a test cleaning composition and a standard, such as a reference cleaning composition, to determine whether or not, and/or to what degree, the test cleaning composition provides a formulation having an enhanced fragrance performance. In some implementations, test and reference cleaning compositions are provided, which each include at least two anionic surfactants, such as LAS and SLES as described herein. In some implementations, the total combined amount of LAS and SLES in the test and reference cleaning compositions ranges from about 0.1 wt % to about 3.5 wt %, such as about 1% to 2% by weight.

In various implementations, the test and reference cleaning compositions each contain the same amount and type of at least one fragrance as described herein. The test and reference cleaning compositions also may contain nonionic surfactants, water and additional components such as buffers, preservatives, coloring agents and water in the types and amounts described herein.

In some implementations, the above-described formulation methods further include evaluating the cleaning compositions to assess their performance. Any method known in the art for evaluating gloss of layers formed by applying the cleaning composition on a surface may be used. For example, in various implementations, gloss performance values may be obtained using gloss units (GU), a panel of experts or an individual expert gloss evaluator. The thus obtained performance values may be compared between the test and reference cleaning compositions to determine if a higher or lower gloss amount of a layer on a surface is measured or perceived from the test composition in comparison to the reference composition or to determine if the gloss after multiple applications, e.g., one application, two applications, three applications or more, is greater or less than for the test cleaning composition. An increase in gloss observed from the test cleaning composition in comparison to the reference cleaning composition indicates that the test cleaning composition provides a formulation having an enhanced shine.

EXAMPLES

Example 1—Cleaning Composition

Reference cleaning composition R1 having a different ratio of LAS:SLES and different ionic agent levels than two Prototype cleaning compositions "A" and "B" having sodium Citrate as the ionic agent were prepared and evaluated. The formulations of prototype cleaning compositions "A" and "B" and reference cleaning composition R1 are shown in Table 1, below with all values reported in wt %. The same amount and type of fragrance was used in each of the compositions that were evaluated. The ratio of LAS to SLES between reference R1 and Prototype B compositions was varied. The ratio of LAS to SLES between reference composition R1 and Prototype A was also varied.

Meanwhile, reference cleaning compositions R2-R5 having the same ratio of LAS:SLES as three prototype cleaning compositions "C", "D", and "E", though each with different ionic levels, were prepared. The ionic agent (NaCl) was increased in amounts (e.g., in the range of from 0.1% to 0.2%) with prototype composition R2 having the lowest amount of ionic agent at 0.12% and reference composition R5 having the highest amount at 0.2%. The formulations of prototype cleaning compositions C-E and reference cleaning compositions R2-R5 are shown in Table 2, below. The same amount and type of fragrance was used in each of the compositions that were evaluated. The ratio of LAS to SLES between the reference compositions R2-R5 and prototypes C-E remained constant at 4:1.

Example 2—Turbidity Evaluation

Turbidity of the prototype compositions A and B were evaluated against turbidity of reference compositions R1 R2. Results of the evaluation are shown in Table 1. 100 ml samples stored in vials were placed in a nephelometer for about 10 seconds. The nephelometer provided turbidity values as reported below.

TABLE 1

| | "R1" LAS:SLES 3.1:1 | "A" LAS:SLES 4:1 | "B" LAS:SLES 3:1 |
|---|---|---|---|
| Water | Q.S. | Q.S. | Q.S. |
| Total Anionic Surfactant Combined LAS & SLES (wt %) | Below 2.0 | Below 2.0 | Below 2.0 |
| Nonionic Surfactant (C9-C11 Pareth 8) (wt %) | 0.5 | 0.45 | 0.45 |
| Colorant (wt %) | Below 0.01 | Below 0.01 | Below 0.01 |
| Fragrance (wt %) | Below 1.0 | Below 1.0 | Below 1.0 |
| Ionic Agent (Na-Citrate) (wt %) | 0.15 | 0.2 | 0.17 |
| Total (wt %) | 100 | 100 | 100 |
| Turbidity (NTU) | 1.5 | 1.9 | 7.8 |
| Delta Gloss Units (After Application of cleaning composition) | 3.24 | 2.15 | 4.23 |

As the turbidity values in Table 1 show, changes in the turbidity of the cleaning composition, which are driven by the different levels of ionic agent together and ratios of the SLES/LAS anionic blend, impacted consumer perception of shine during consumer testing.

Example 3—Turbidity & Gloss Evaluation

Turbidity of prototype compositions C-E were evaluated against turbidity of reference compositions R2-R5. Additionally, the gloss for layers formed by application of cleaning compositions of prototype cleaning compositions C-E onto a substrate were evaluated and compared with gloss for layers formed by application of the reference cleaning compositions R3 and R6.

To test gloss, vinyl tiles (10 cm×10 cm) were cleaned with alcohol and an initial gloss of the vinyl tile surface was measured. A predetermined amount, here of 0.5+/−0.05 grams of undiluted cleaning composition was applied to the surface of the vinyl tiles and spread using paper towels to form a first uniform layer. The compositions were left undisturbed to dry at room temperature for about 20 minutes. Gloss of the vinyl tile surface was measured again after application of cleaning compositions. The process of forming the layer was repeated on two additional treatments, each a day apart, with additional cleaning composition (0.5+/−0.05 grams per day) being formed over previous applications thereof. Because the three applications followed the same procedure and it were done on the same surface. On day 1, 0.5 gram was applied on the tile, followed by a second 0.5 gram application on day 2, and followed by a third 0.5 gram application on day 3. So at the end it was applied 1.5 grams of product in total on the tile after the 3 days. The gloss after each application was evaluated. Turbidity and shine enhancement for cleaning compositions B-D and the reference compositions R3-R6 over three applications is shown in Table 2.

TABLE 2

| Composition | "C" | . "D" | . "E" | "R2" | "R3" | "R4" | "R5" |
|---|---|---|---|---|---|---|---|
| Water | Q.S. | Q.S. | Q.S. | Q.S. | Q.S. | Q.S. | Q.S. |
| Total Anionic Surfactant Combined LAS & SLES (wt %) (LAS:SLES at 4:1) | Below 2.0 | Below 2.0 | Below 2.0 | Below 2.0 | Below 2.0 | Below 2.0 | Below 2.0 |
| Nonionic Surfactant (C9-C11 Pareth 8) | 0.45 | 0.45 | 0.45 | 0.45 | 0.45 | 0.45 | 0.45 |
| Colorant (wt %) | Below 0.01 | Below 0.01 | Below 0.01 | Below 0.01 | Below 0.01 | Below 0.01 | Below 0.01 |
| Fragrance | Below 1.0 | Below 1.0 | Below 1.0 | Below 1.0 | Below 1.0 | Below 1.0 | Below 1.0 |
| Ionic Agent (NaCl) (wt %) | 0.12 | 0.135 | 0.143 | 0.15 | 0.175 | 0.188 | 0.2 |
| Total wt % | 100 | 100 | 100 | 100 | 100 | 100 | 100 |
| Turbidity (NTU) | 4.09 | 7.22 | 8.05 | 13 | 14 | 20.8 | 29.26 |
| Delta Gloss Units (After 1 Day Application of Cleaning Composition, -0.5 gram accumulation) | 2.69 | 2.41 | 2.54 | 0.32 | 0.60 | 1.15 | 0.34 |
| Delta Gloss Units (After 2$^{nd}$ Cumulative Day of Application of Cleaning Composition, - 1.0 gram accumulation) | 3.85 | 3.46 | 3.96 | 0.67 | 0.50 | 0.75 | 0.54 |
| Delta Gloss Units (After 3$^{rd}$ Cumulative Day of Application of Cleaning Composition - 1.5 gram accumulation) | 3.84 | 3.76 | 3.66 | 0.93 | 0.54 | 0.29 | 0.66 |
| Delta Gloss Units (on average) | 3.46 | 3.21 | 3.39 | 0.64 | 0.54 | 0.73 | 0.51 |

From the data shown in Table 2, it is noted that for each of the cleaning compositions C-E and R2-R5, the resulting initial gloss of layers formed by the composition shows a markedly high gloss profile for those compositions having a turbidity of less than or equal to about 10 NTU. Additionally, as shown in Table 2, gloss was unexpectedly enhanced for prototypes C-E as compared with those of reference compositions R2-R5. From these results it is evident that shine of a cleaning composition in which the amount of LAS, SLES, fragrance, water and other ingredients are known, and for which an ionic solid is added in order to reduce the turbidity thereof, can be enhanced.

What is claimed is:

1. A cleaning composition consisting of:

at least two anionic surfactants, wherein the at least two anionic surfactants comprise a linear alkylbenzene sulfonate (LAS) and a sodium lauryl ether sulfate (SLES), wherein the LAS and the SLES are present in the cleaning composition in a total amount combined of about 1%-2% by weight and wherein a weight ratio of LAS:SLES is about 2:1 to about 5:1;

an ionic agent sodium chloride in an amount of from about 0.12 to about 0.143% by weight;

a nonionic surfactant comprising $C_9$-$C_{11}$ alkanol condensed with ethylene oxide in an amount of about 0.01% to about 1% by weight, a fragrance, and one or more optional ingredients selected from water, colorants and preservatives.

2. The cleaning composition of claim 1, wherein the cleaning composition is a bucket-dilutable cleaning composition.

3. The cleaning composition of claim 1, wherein the LAS:SLES ratio is about 4:1.

4. The cleaning composition of claim 1, wherein the C9-C11 alkanol is condensed with 7 to 8 moles of ethylene oxide.

5. The cleaning composition of claim 1, wherein the cleaning composition has a turbidity of less than 13 NTU, such as less than 10 NTU.

6. The cleaning composition of claim 1, wherein the cleaning composition has a turbidity of from about 4 NTU to about 9 NTU.

7. A method of preparing a cleaning composition of claim 1, wherein the cleaning composition includes a fragrance, the method comprising:

combining at least two anionic surfactants, wherein the at least two anionic surfactants comprise a linear alkylbenzene sulfonate (LAS) and a sodium lauryl ether sulfate (SLES), to form a mixture having a weight ratio of LAS:SLES of about 2:1 to about 5:1;

adding the mixture, an ionic agent sodium chloride; and a nonionic surfactant comprising $C_9$-$C_{11}$ alkanol condensed with ethylene oxide to the cleaning composition, wherein the cleaning composition includes a fragrance;

wherein the mixture comprises a total amount combined of LAS and SLAS of about 1% to about 2% by weight of the cleaning composition, wherein the ionic agent comprises an amount of from about 0.12% to about 0.143% by weight of the cleaning composition, and wherein the nonionic surfactant comprises an amount of about 0.01% to about 1% by weight of the cleaning composition.

8. The method of claim 7, wherein the C9-C11 alkanol is condensed with 7 to 8 moles of ethylene oxide.

9. The method of claim 7, wherein the cleaning composition has a turbidity of less than about 10 NTU.

10. The method of claim 7, wherein the fragrance is present in the cleaning composition in an amount of about 0.5% to about 2% by weight.

11. The method of claim 7, wherein the cleaning composition is a bucket-dilutable cleaning composition.

12. A method of cleaning a substrate, the method comprising:

applying the cleaning composition of claim 1 to the substrate; and wiping the fragrance-enhanced cleaning composition across the substrate.

13. The method of claim 12, wherein the cleaning composition is a bucket-dilutable cleaner.

14. The cleaning composition of claim 1, wherein the fragrance is present in an amount of about 0.5% to about 2% by weight.

* * * * *